US005219184A

United States Patent [19]

Wolf

[11] Patent Number: 5,219,184

[45] Date of Patent: Jun. 15, 1993

[54] GIFT CARD INCORPORATING THANK YOU NOTE AND METHOD

[76] Inventor: Ilene Wolf, 4405 Heritage Dr., Apt. A11, Okemos, Mich. 48864

[21] Appl. No.: 967,736

[22] Filed: Oct. 27, 1992

[51] Int. Cl.[5] ..... G09F 3/00

[52] U.S. Cl. ..... 283/56; 229/68 R; 40/124.1; 446/147

[58] Field of Search ..... 283/101, 103, 105, 56, 283/116; 229/68; 40/124.1; 446/147

[56] References Cited

U.S. PATENT DOCUMENTS

| | | | |
|---|---|---|---|
| 4,613,157 | 9/1986 | Drabish | 283/101 |
| 4,907,826 | 3/1990 | Versage | 283/56 |
| 4,957,311 | 9/1990 | Geisenheimer | 283/56 |
| 5,100,179 | 3/1992 | Burden et al. | 283/56 |

*Primary Examiner*—Mark Rosenbaum
*Assistant Examiner*—Willmon Fridie, Jr.
*Attorney, Agent, or Firm*—Harness, Dickey & Pierce

[57] ABSTRACT

A gift card is disclosed for accompanying a gift expressing awareness of an occasion and providing a return note expressing gratitude. The gift card has a fold which defines a first portion provided with language expressing awareness of the occasion, and a second portion having language expressing gratitude for the gift and gift card. The back side of the second portion is provided with the return address of the sender. A majority of the second portion is removably affixed to the remainder of the gift card, such that the return note expressing gratitude may be removed to form a thank you card which may be mailed from the recipient back to the sender.

16 Claims, 2 Drawing Sheets

GIFT CARD INCORPORATING THANK YOU NOTE AND METHOD

BACKGROUND OF THE INVENTION

1. Technical Field

This invention relates generally to gift cards, and more particularly to a gift card for expressing awareness of an occasion and providing a return note expressing gratitude.

2. Discussion

Numerous gifts are given each year, and many gifts are accompanied by a gift card expressing awareness of any of a variety of special occasions. Such occasions include birthdays, anniversaries, Father's Day, Mother's Day, Thanksgiving, graduation, Christmas, Easter, Hanukkah, Valentines Day, or a wedding. The recipient of the gift and gift card often feels an obligation to mail the sender a return thank you note expressing gratitude for the gift.

Typical thank you notes may range from personal letters to pre-printed cards which can be purchased at card stores and the like. Most gift recipients fully intend to send a thank you note. However, the effort of traveling to a card store specifically for a thank you note, composing an appropriate thank you expression, and mailing the card is sufficient to discourage many recipients from sending a thank you note. Moreover, a gift recipient often procrastinates and may eventually fail to send any thank you note at all, rather than send a very tardy note. This tendency is unduly multiplied when several gifts are received for a single occasion, such as a wedding, for which the task of writing so many thank you notes may often seem overwhelming. The result is that the recipient may forget or otherwise fail to send a thank you note. This failure to send a thank you note results in the sender being uncertain as to whether the gift was ever received, and causes the recipient to regret their failure to properly express their gratitude for the gift.

SUMMARY OF THE INVENTION

According to the present invention, a gift card is disclosed for accompanying a gift from a sender to a recipient expressing awareness of an occasion and providing a return note expressing gratitude. The gift card has at least one fold which defines a first and second portion. The first portion is provided with language expressing awareness of the occasion. The second portion is provided with language expressing gratitude for the gift and gift card. The back side of the second portion is provided with the return address of the sender. A majority of the second portion is removably affixed to the remainder of the gift card, such that the return note expressing gratitude may be removed to form a thank you card which may be mailed from the recipient back to the sender.

It is an object of the present invention to simplify the process of sending thank you notes for gifts received.

It is further an object of the present invention to provide a thank you note with the gift card such that a minimum amount of effort is required to send a thank you note.

The various advantages and features of the present invention will become apparent from the following description and claims in conjunction with the accompanying drawings:

DETAILED DESCRIPTION OF THE PREFERRED EMBODIMENTS

The following description of the preferred embodiments is merely exemplary in nature and is in no way intended to limit the invention or its application or uses.

Figure 1:
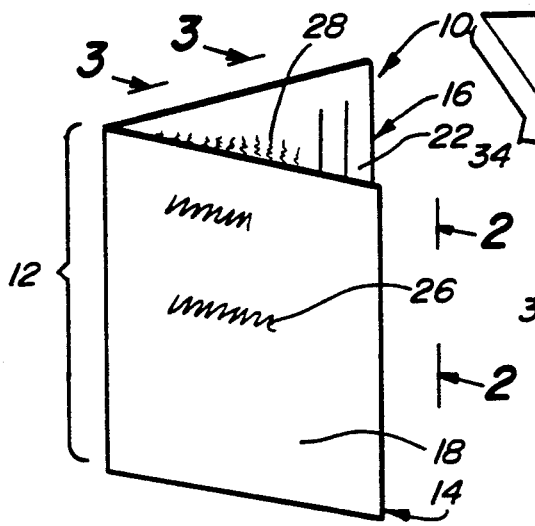
FIG. 1 is a perspective view of a gift card according to the principles of the present invention.
Figure 2:
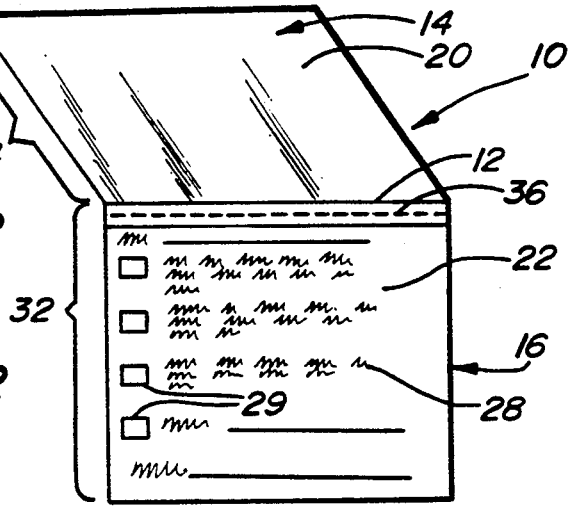
FIG. 2 is a perspective view of the gift card of FIG. 1 in the direction of arrows 2—2.
Figure 3:
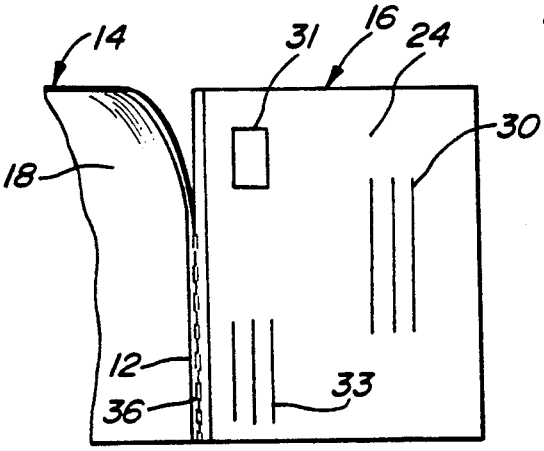
FIG. 3 is a partial perspective view of the gift card of FIG. 1 in the direction of arrows 3—3, showing the thank you note partially removed from the remainder of the gift card.

Referring to the drawings, a gift card is generally shown at 10 in FIGS. 1 through 3. Gift card 10 is preferably formed of paper in a rectangular shape, but may be constructed of other materials, such as plastic, or in other shapes, such as circular or triangular. Gift card 10 has a fold 12 defining a first portion 14 and a second portion 16. First portion 14 has a front side 18 and a back side 20. Second portion 16 similarly has a front and back side 22 and 24. Fold 12 allows card 10 to be placed in an open or closed position. Back side 20 of first portion 14 is placed in adjacent contact with front side 22 of second portion 16 when gift card 10 is in the closed position. Back side 20 and front side 22 are of course spaced apart when gift card 10 is in the open position. As will be readily appreciated in a preferred embodiment, the card may be placed in an envelope and actually attached to the gift or the package or wrapping.

Figure 4:
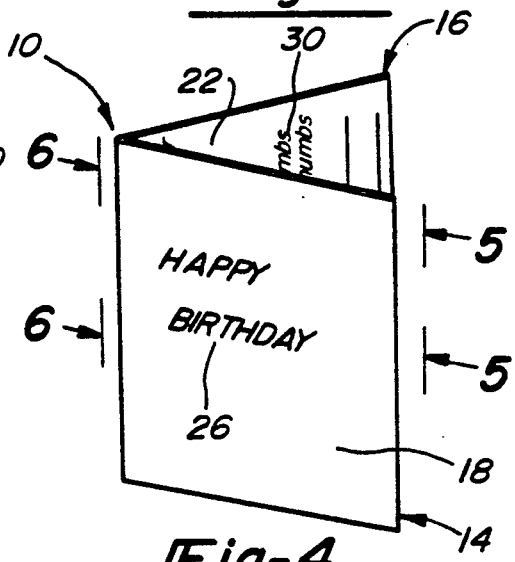
FIG. 4 is a perspective view of a gift card according to the principles of the present invention showing exemplary language.

Front side 18 of first portion 14 is provided with language 26 expressing awareness of an occasion. Gift card 10 may be used to express awareness of almost any special occasion for which a gift may be sent from a sender to a recipient. As a result, language 26 can take almost any form, including a statement, a question, or a comment. Moreover, the words of language 26 can be stated in any language. A specific example of language 26 is shown in FIG. 4, in which language 26 states the greeting "Happy Birthday".

Figure 5:
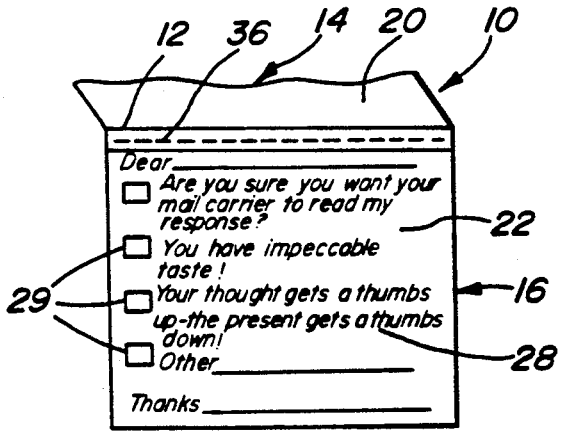
FIG. 5 is a view similar to that of FIG. 2 showing the gift card of FIG. 4.

Front side 22 of second portion 16 is provided with language 28 expressing gratitude for the gift and for gift card 10. Language 28 can take almost any form, including statements and questions, as well as almost any tone, such as sincere, humorous, or sarcastic. A specific example of the text and the arrangement of language 28 is shown in FIG. 5. Although language 28 may state almost anything, it preferably includes a plurality of possible responses, as shown in FIG. 5. Each pre-printed response may be provided with an associated box 29 or any other shape or icon for allowing the recipient to select one of the responses. As a result, boxes 29 and the pre-printed responses alleviate much of the effort involved in acquiring, composing, or preparing a conventional thank you note.

Figure 6:
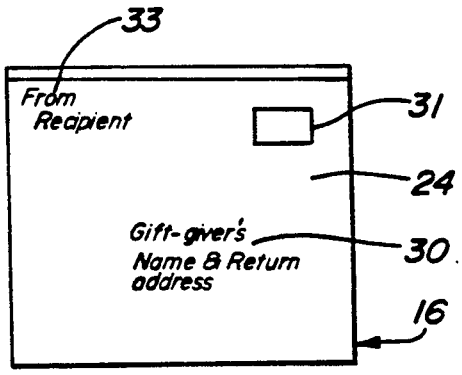
FIG. 6 is a partial perspective view of a portion of the gift card shown of FIG. 4 in the direction of arrows 6—6.

Back side 24 of second portion 16 is provided with language 30 indicating the address of the sender as shown in FIGS. 3 and 6. In addition, back side 24 of second portion 16 may also be provided with postage 31 for transportation by a mail carrier from the recipient back to the sender. Further, back side 24 may also be provided with a return address 33 of the recipient.

A return thank you note 32 expressing gratitude for the gift is formed by a majority of second portion 16 which is removably affixed to a remainder 34 of gift card 10. In the preferred embodiment, the recipient may simply mark one of the boxes 29 to indicate a desired response, and/or fill in any blanks which may be preprinted on thank you note 32.

Thank you note 32 is preferably removably affixed to the remainder 34 of the card by perforations 36 which form a line of weakening. This line of weakening may of course be straight or curved, or may have various shapes for decorative purposes, such as a saw tooth pattern or a sine wave or a square wave. In addition, thank you note 32 may be formed as a post card which is removably affixed to remainder 34 of gift card 10 by an adhesive or the like. It will be readily appreciated that other forms of connection may be utilized, provided they are designed to allow easy removal of thank you note 32 from the remainder 34 of gift card 10.

Figure 7:
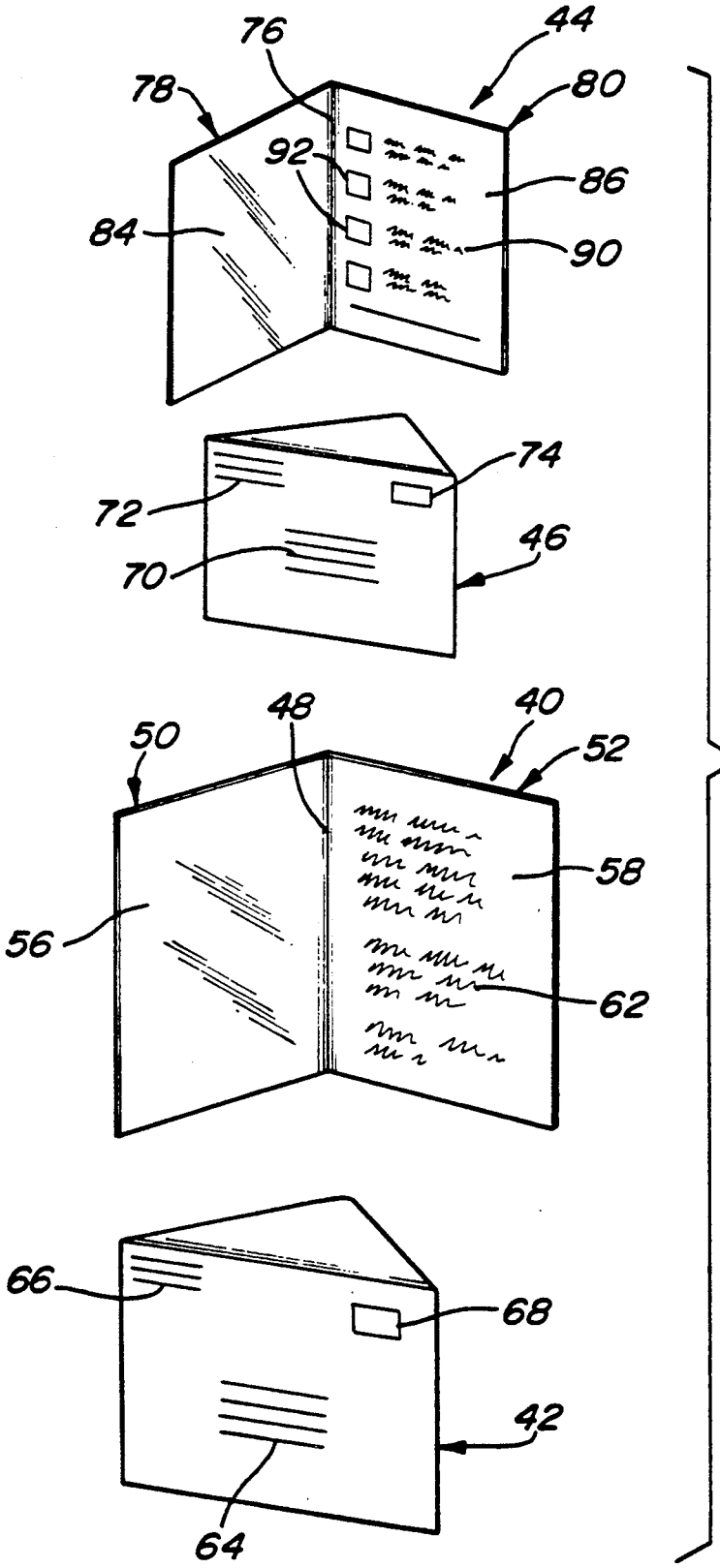
FIG. 7 is an exploded perspective view of a gift card and enclosed thank you note embodying the principles of an alternative embodiment of the present invention.

An alternative embodiment of the present invention is shown in FIG. 7, which consists of a gift card 40 and envelope 42 as is known in the prior art, as well as a thank you card 44 and an associated smaller envelope 46. Greeting card 40 is formed as in the prior art, having a fold 48 defining a first and second portion 50 and 52 respectively, each having a front side 54 and 58, and a back side 56 and 60. Fold 48 allows gift card 40 to be placed in an open or closed position. Front sides 54 and 58 of first and second portions 50 and 52 are provided with language 62 expressing awareness of an occasion. Envelope 42 is preferably provided with the recipient's address 64 and the sender's return address 66, as well as postage 68. Envelope 46 is conversely provided with the sender's address 70 and the recipient's return address 72 and postage 74. Thank you card 44 also has a fold 76 defining a first and second portion and allowing thank you card 44 to be placed in an open and a closed position. Both first and second portions 78 and 80 have a front side 82 and 86 and a back side 84 and 88.

Front side 86 of second portion 80 is provided with language 90 expressing gratitude for the gift and gift card 40. Language 90 preferably includes a plurality of various responses and associated boxes 92 similar to those shown in thank you note 32 depicted in FIGS. 2 and 5. Boxes 92 and the pre-printed responses again reduce the effort required for the recipient of the gift to mail a thank you note to the sender.

The sender may place greeting card 40 in a closed position within envelope 42, and thank you card 44 within smaller envelope 46, and finally may place the combined thank you card 44 and envelope 46 also within the larger envelope 42.

As can be seen from the preceding description as well as the drawings, the present invention provides a simple and convenient method for recognizing an occasion and conjunctively providing an accompanying return thank you note or card for accompanying a gift. This invention makes it very convenient for the recipient of a gift to mail a thank you note to the sender of the gift with a minimum of effort.

It should be understood that an unlimited number of configurations of the present invention can be realized which satisfy the requirements described above. The foregoing discussion discloses and describes merely exemplary embodiments of the present invention. One skilled in the art will readily recognize from the discussion and from the accompanying drawings and claims, that various changes and modifications can be made without departing from the spirit and scope of the invention, as defined in the following claims.

I claim:

1. A gift card for accompanying a gift from a sender to a recipient expressing awareness of an occasion and providing a return note expressing gratitude, comprising:

a card having at least one fold, said fold defining a first and second portion and allowing said card to be placed in an open position and a closed position, said first and second portions each having a front and back side, said back side of said first portion being in adjacent contact with said front side of said second portion when said card is in said closed position;

one of said sides of said first portion being provided with language expressing awareness of an occasion, said one of said sides of said second portion being provided with language expressing gratitude, and the other of said sides of said second portion being provided with a predetermined space for language indicating an address of said sender; and a majority of said second portion being removably affixed to a remainder of said card, such that said majority of said second portion may be removed from said remainder of said card, thereby forming said return note expressing gratitude.

2. The gift card as set forth in claim 1, wherein said other of said sides of said second portion which forms said return note is provided with postage for transportation by a mail carrier from said recipient to said sender.

3. The gift card as set forth in claim 1, wherein said other of said sides of said second portion is provided with a predetermined space for language indicating a return address of said recipient.

4. The gift card as set forth in claim 1, wherein said language being provided on said one of said sides of said second portion includes a plurality of pre-printed responses, each of said responses having an associated box pre-printed on said one of said sides of said second portion for allowing said recipient to select one of said responses.

5. The gift card as set forth in claim 1, wherein said card is formed of paper.

6. The gift card as set forth in claim 1, wherein said card is formed in a rectangular shape.

7. The gift card as set forth in claim 1, wherein said majority of said second portion is removably affixed to said remainder by perforations which form a line of weakening.

8. The gift card as set forth in claim 1, wherein said majority of said second portion is formed as a post card being removably affixed to said remainder of said card by adhesive.

9. A gift card for accompanying a gift from a sender to a recipient expressing awareness of an occasion and providing a return note expressing gratitude, comprising:

a first card having at least one fold, said fold defining a first and second portion and allowing said first card to be placed in an open position and a closed position, said first and second portions of said first card each having a front and back side, said back side of said first portion being in adjacent contact with said front side of said second portion when said first card is in said closed position, at least one of said sides of said first and second portions being provided with language expressing awareness of an occasion;

a first envelope adapted to enclose said first card therewithin when said first card is in said closed position;

a second card having at least one fold, said fold defining a first and second portion and allowing said second card to be placed in an open position and a closed position, said first and second portions of said second card each having a front and back side, said back side of said first portion of said second card being in adjacent contact with said front side of said second portion of said second card when said second card is in said closed position, at least one of said sides of said second portion of said second card being provided with language expressing gratitude; and a second envelope adapted to enclose said second card therewithin when said second card is in said closed position, said second envelope being provided with a predetermined space for language indicating an address of said sender and being formed to fit within said first envelope, thereby forming said gift card and said return note expressing gratitude.

10. The gift card as set forth in claim 9, wherein said second envelope is provided with postage for transportation by a mail carrier from said recipient to said sender.

11. The gift card as set forth in claim 9, wherein said second envelope is provided with a predetermined space for language indicating a return address of said recipient.

12. The gift card as set forth in claim 9, wherein said language being provided on said one of said sides of said second portion of said second card includes a plurality of pre-printed responses, each of said responses having an associated box pre-printed on said one of said sides of said second portion of said second card for allowing said recipient to select one of said responses.

13. The gift card as set forth in claim 9, wherein said card is formed of paper.

14. The gift card as set forth in claim 9, wherein said card is formed in a rectangular shape.

15. The gift card as set forth in claim 9, wherein said majority of said second portion is removably affixed to said remainder by perforations which form a line of weakening.

16. The gift card as set forth in claim 9, wherein said majority of said second portion is formed as a post card being removably affixed to said remainder of said card by adhesive.

* * * * *